US007444790B2

(12) United States Patent
Hick

(10) Patent No.: US 7,444,790 B2
(45) Date of Patent: Nov. 4, 2008

(54) WEATHER STRIPS

(75) Inventor: Robert Mainland Hick, West Willunga (AU)

(73) Assignee: Nu-Lok Roofing Systems Pty, Ltd., Adelaide (AU)

( * ) Notice: Subject to any disclaimer, the term of this patent is extended or adjusted under 35 U.S.C. 154(b) by 635 days.

(21) Appl. No.: 10/480,426

(22) PCT Filed: Sep. 7, 2001

(86) PCT No.: PCT/AU01/01122

§ 371 (c)(1),
(2), (4) Date: Dec. 10, 2003

(87) PCT Pub. No.: WO03/023164

PCT Pub. Date: Mar. 20, 2003

(65) Prior Publication Data

US 2004/0148898 A1 Aug. 5, 2004

(51) Int. Cl.
*E04D 1/34* (2006.01)

(52) U.S. Cl. ..... 52/547; 52/546

(58) Field of Classification Search ..... 52/543, 52/551, 547, 550, 544, 546, 396.1, 716.1, 52/545, 549, 520, 712, 489.1; 24/457, 458, 24/711.3, 27

See application file for complete search history.

(56) References Cited

U.S. PATENT DOCUMENTS

| | | | | | |
|---|---|---|---|---|---|
| 853,063 | A | * | 5/1907 | Coffin | 52/533 |
| 1,000,819 | A | * | 8/1911 | Kleinhans | 52/466 |
| 1,158,940 | A | * | 11/1915 | Litt | 40/659 |
| 1,173,499 | A | * | 2/1916 | Fleischmann | 52/546 |
| 1,544,391 | A | * | 6/1925 | Budd et al. | 52/547 |
| 1,820,015 | A | * | 8/1931 | Figge | 52/545 |
| 1,895,038 | A | * | 1/1933 | Jones | 52/520 |
| 2,017,230 | A | * | 10/1935 | Black | 52/545 |
| 2,097,715 | A | * | 11/1937 | Bartsch | 52/544 |
| 2,106,948 | A | * | 2/1938 | Harrington | 52/547 |
| 2,149,818 | A | * | 3/1939 | North | 52/409 |
| 3,707,742 | A | * | 1/1973 | Justice et al. | 24/377 |
| 4,422,278 | A | * | 12/1983 | Fujihiro et al. | 52/714 |
| 4,716,632 | A | * | 1/1988 | Perl | 24/289 |
| 5,617,690 | A | * | 4/1997 | Gibbs | 52/518 |
| 5,642,596 | A | * | 7/1997 | Waddington | 52/546 |
| 5,794,396 | A | * | 8/1998 | Gibbs | 52/518 |
| 5,921,045 | A | * | 7/1999 | Hickey et al. | 52/543 |
| 6,052,961 | A | * | 4/2000 | Gibbs | 52/518 |

FOREIGN PATENT DOCUMENTS

| | | | |
|---|---|---|---|
| AU | 709435 | * | 8/1999 |
| AU | 199926922 | A1 | 8/1999 |
| FR | 9008445 | A1 | 7/1999 |

* cited by examiner

*Primary Examiner*—Robert Canfield
*Assistant Examiner*—Christine T Cajilig
(74) *Attorney, Agent, or Firm*—Charles C.H. Wu; Wu & Cheung, LLP

(57) ABSTRACT

A weather strip (10) for supporting tiles on battens on a roof, the weather strip including side flanges (14) and a retention means comprising a wire clip, the wire clip being substantially U-shaped with extending legs, ears (38) on legs to engage in slots (40) in the side flanges (14) and each leg terminating in a hook (30) to engage the lower end of a tile.

2 Claims, 4 Drawing Sheets

WEATHER STRIPS

FIELD OF THE INVENTION

Figure 1:
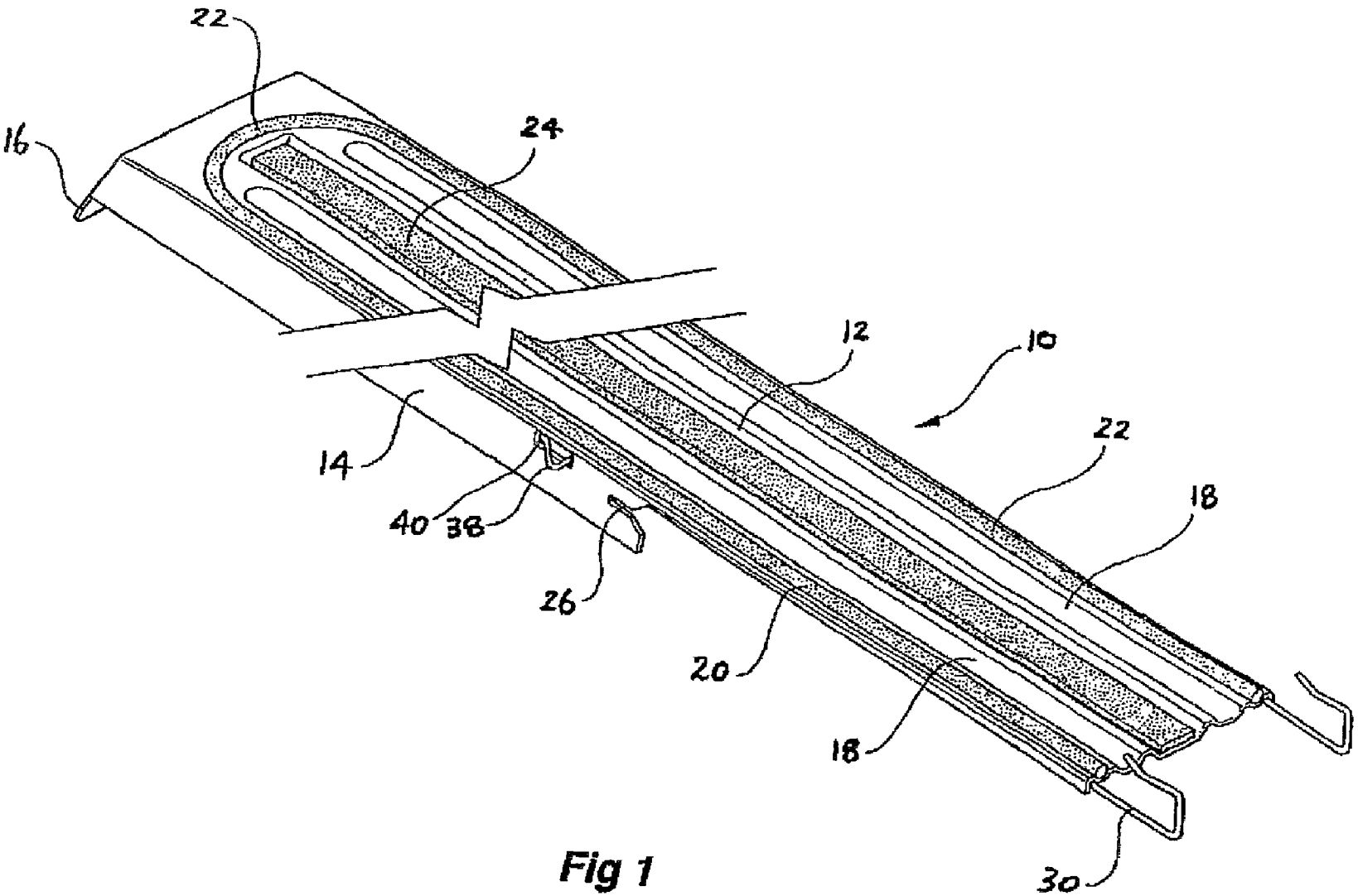

The present invention relates to the securing and weatherproofing of tiles, more preferably flat shingles or tiles, to a roof structure. The invention will in part be described in relation to flat type tiles but it should be appreciated that the invention is not so limited. The term tile used herein shall be taken to mean a roof tile or a slate or timber or other material shingle or any similar roofing material.

BACKGROUND ART

Various roofing systems for fixing flat shingles or tiles to a roof are known in the prior art.

For example, Australian Patent No. 672286 discloses a tile roofing system in which spaced apart parallel joining strips extend between a pair of adjacent battens and wherein each shingle or tile is supported along its opposite margins by a pair of adjacent said strips. In this Patent specification locking means are provided integrally with a strip for securing the lower end portion of a respective tile against lifting. These strips are known in the art as "weather strips" and prevent moisture, dust etc. from passing between tiles and into the roof space. In Patent No. 672286 two forms of the integral locking means are disclosed. In one embodiment, integral tabs are provided at the lower end of each weather strip and are bent over a lower edge of a respective tile or shingle. In a second embodiment, each weather strip has an upstanding hook generally centrally positioned therein, and this hook projects upwardly to engage the lower end of a shingle or tile in the next uppermost row from the weather strip to prevent lifting of that shingle or tile.

GB Patent Application No. 2160559 shows a weather strip having an upstanding hook like member which engages the lower end of a shingle or tile in the next uppermost shingle or tile row from the weather strip. The arrangement in GB 2160559 is virtually identical to the arrangement disclosed in the Australian Patent No. 672286.

DE 800784 discloses a weather strip which extends between upper and lower battens, and a lower end of the weather strip is provided with tabs which engage with a lower end portion of the respective tile.

In the arrangements shown in the above documents, the various tab and hook type arrangements are provided to restrain the lower end of a respective tile to prevent its upward lift, for instance, from strong wind conditions etc.

In practice, however, installations which have used the system disclosed in, for instance, Australian Patent No. 672286 have exhibited poor weatherproofing and problems with corrosion with the portion bent or extending over the lower end of the tile.

It would be advantageous if an alternative retention system for securing tiles, especially flat type tiles or shingles, could be provided which would not have the corrosion problem.

SUMMARY OF THE INVENTION

In one form therefore, although this may not be the only or broadest form the invention is said to reside in a weather strip adapted to support roof tiles and to extend between adjacent roof battens and to be supported thereby, each weather strip having a length such that in use its lower end portion projects beyond the lower one of the adjacent battens, whereby each tile is supported along its opposite margins by adjacent weather strips with the top surface of each said strip being in contact with and supporting adjacent marginal edge portions of adjacent tiles positioned in edge-to-edge relationship, wherein the weather strip includes a tile retention means adapted to prevent a tile when retained from lifting, the retention means comprising a wire clip engaged into the weather strip and having at least one leg with a hooked portion adapted to engage the lower end of a tile in use.

Preferably the wire of the wire clip is made from a resilient wire. Preferably the wire is a stainless steel wire.

In one form the retention means may comprise a substantially U shaped body of wire having substantially parallel legs in use, an ear extending laterally from each leg, each ear adapted in use to engage in an aperture in a side flange of the weather strip and each leg terminating in the hooked portion. As manufactured the legs may be divergent but being resilient so that in use each ear is retained in its respective aperture.

The weather strip may have at least two longitudinal strips of sealant means in use adapted to seal under the respective sides of adjacent tiles. The weather strip may also have a broader central longitudinal sealing strip. The side edges of adjacent tiles may rest on the broader central longitudinal sealing strip.

The weather strip may also include longitudinally extending grooves formed in its upper surface to assist with the shedding of water therefrom. The longitudinally extending grooves may be between the two longitudinal strips and the broader central longitudinal sealing strip.

Where the weather strip is to be used with timber battens it may include side tabs in the position of the lower batten in use adapted for enabling the weather strip to be fastened to the wooden batten by nailing or screwing and also an upper tab adapted to be nailed to the upper of the adjacent battens.

Alternatively where the weather strip is to be used with metal battens the weather strip may include engagement means adapted to engage with the lower one of the adjacent battens wherein the engagement means comprises a locating slot adjacent an underside surface of the weather strip near to and opening in the direction of its lower end whereby an upper flange of the lower one of the adjacent battens being received into the locating slot in use. The upper end of the weather strip may rest upon a lower flange of the upper of the adjacent battens.

The weather strip may include a downwardly depending tab at the upper end of the weather strip, the tab engaging in a corrugation of a lower flange of a support batten in use.

The weather strip may further include downwardly depending side flanges on the weather strip, the side flanges being slightly angled outwards to allow for stacking of the weather strips.

The hooked portion may be adapted for receiving and retaining tiles of different thicknesses by means of a substantially U shaped clip portion at the second end adapted so that the lower edge of the tile is received in the U shape and a portion of the U shape of the clip bears down on the upper surface of the tile in a resilient manner.

This then generally describes the invention but to assist with understanding reference will now be made to the accompanying drawings which show a preferred embodiment of the invention.

Figure 2:
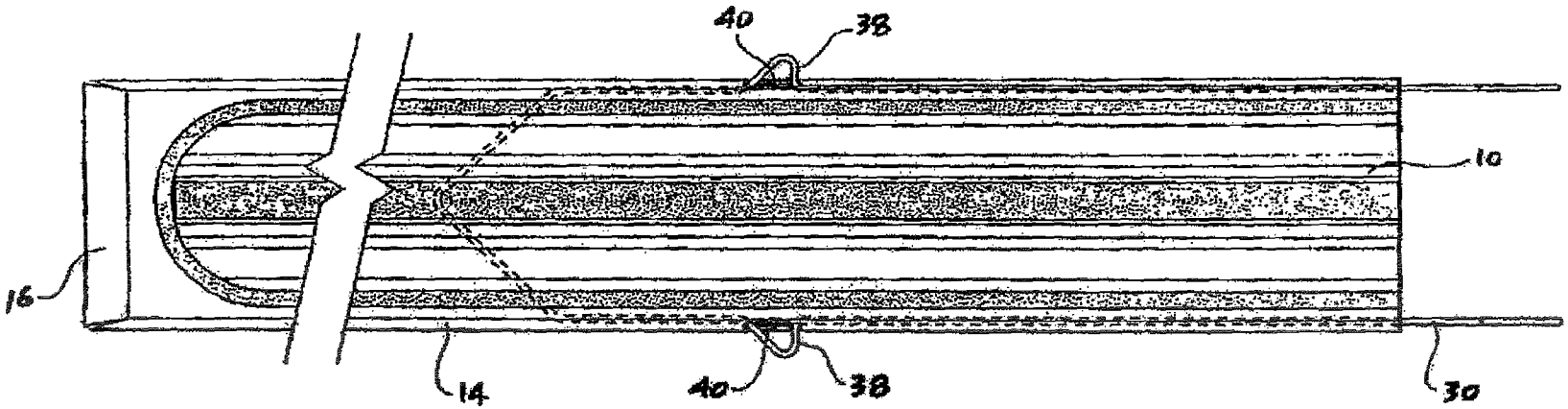
Figure 3:
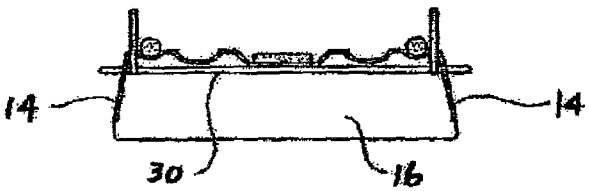
Figure 4:
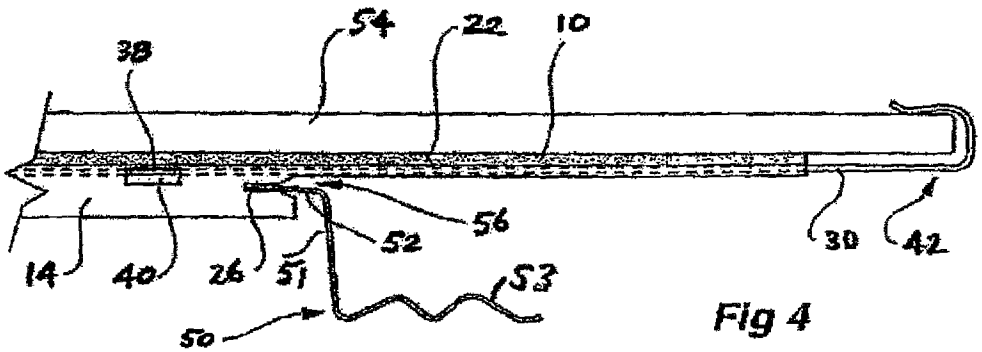
Figure 5:
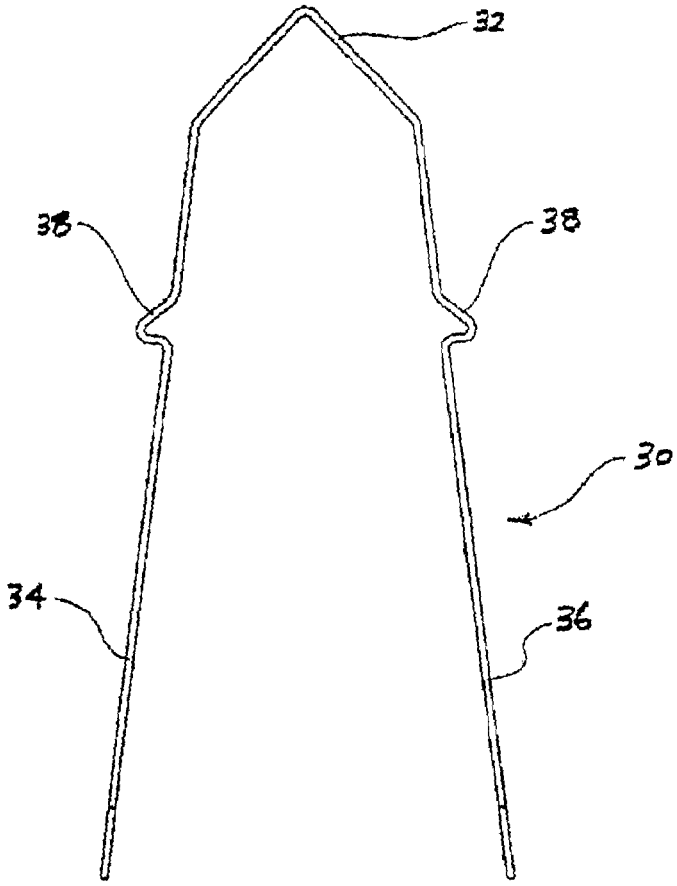
Figure 6:
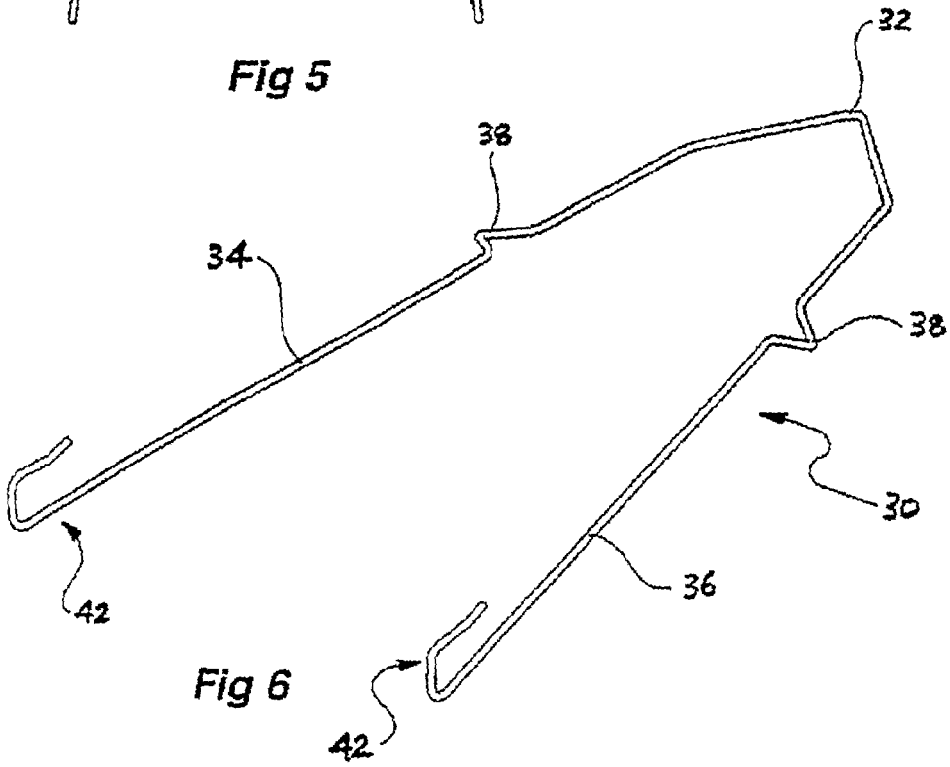

In the drawings:

FIG. 1 shows a perspective view of an embodiment of the weather strip according to this invention, FIG. 2 shows a plan view of the embodiment shown in FIG. 1, FIG. 3 shows an end elevation of the embodiment shown in FIG. 1, FIG. 4 shows a cross sectional view of portion of the weather strip of the present invention when installed on one embodiment of roof batten and including a tile mounted on the weather strip, FIG. 5 shows a plan view of one embodiment of the retaining clip useful for the weather strip of the present invention, and FIG. 6 shows a perspective view of the retaining clip.

Figure 7:
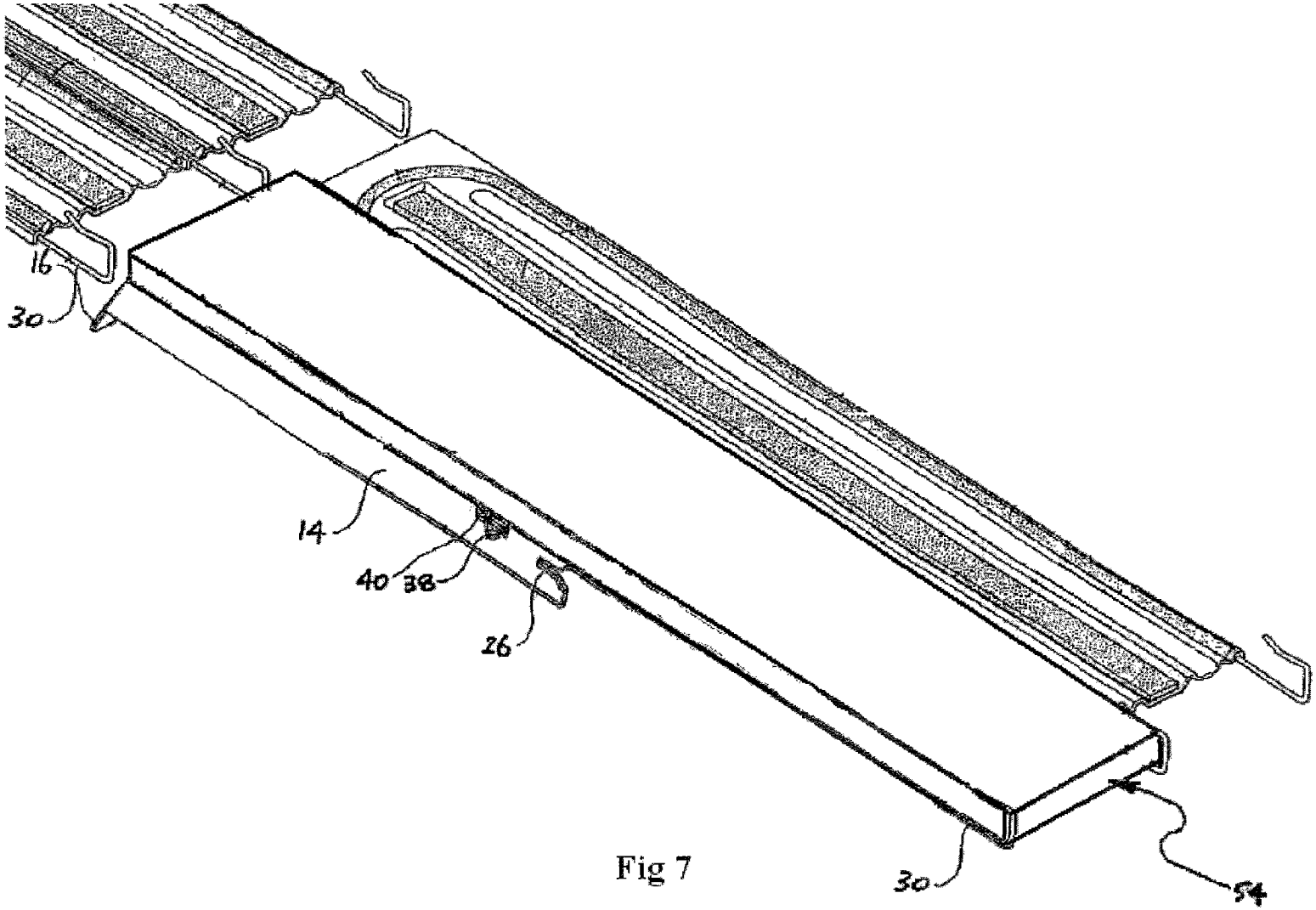

FIG 7 shows a perspective view of the current invention.

The terms "upper" and "lower" as used in the following description and claims are related to the position of the weather strip and clip when in use on a sloping roof.

Now looking more closely at the drawings it will be seen that the weather strip generally 10 comprises a top surface 12, depending side flanges 14 and an upper end tab 16 on the end of the weather strip when in use is uppermost on the roof. On the top surface 12 are a pair of grooves 18 a peripheral sealing strip 20 which extends up each side of the weather strip and curves over the top in an arcuate band 22. There is also a central broader sealing strip 24 which is broader than the side sealing strips 20. The two longitudinal strips of sealant means in use are adapted to seal under the respective sides of adjacent tiles.

The side edges of adjacent tiles may rest on the broader central longitudinal sealing strip as shown in FIG. 7.

The side flanges 14 on each side of the weather strip terminate before the lower end of the weather strip and where the side flange terminates there is a recess 26 opening towards the lower end of the weather strip which in use engages with a flange of a roof batten 50 as will be explained in more detail in relation to FIG. 4.

Mounted to and underneath the, weather strip 10 is the tile retention clip 30. The tile retention clip 30 can be seen in most detail in FIGS. 5 and 6. The tile retention clip is of a generally U shaped having an upper end 32 and legs 34 and 36 along which are ears 38. These ears 38 engage in apertures 40 in the side flanges 14 of the weather strip when the retaining clip is mounted into the weather strip to hold it in place. The legs 34 and 36 are divergent as seen in FIGS. 5 and 6 but as the retaining clip is manufactured from resilient wire they can be moved together to enable the ears to be positioned into the apertures 40 at which stage the legs are substantially parallel to each other, the resiliency of the wire retaining the ears 38 in the apertures 40.

Each of the legs 34 and 36 terminate in a hooked portion 42 with the hooked portions extending at right angles to the general plane of the retaining clip.

Now looking at the assembly view in FIG. 4 it will be seen that a roof batten 50 is of a Z shaped type having an upstanding web 51 with a top flange 52 and a bottom flange 53, the top flange 52 and the bottom flange 53 extending in opposite directions. The lower flange 53 is advantageously longitudinally corrugated. The end of the top flange 52 is received in the slot 26 in the end of the side flange 14 of the weather strip. A tile 54 sits on the weather strip 10 engaging the sealing strip 22 to provide a seal along the side edge of the tile. The hooked portion 42 of the retaining clip 30 extends over the tile 54 and engages the top surface of the tile to prevent movement of the tile. The hooked portion 42 is sufficiently resilient that different thicknesses of the tile can be received in the hooked portion although retaining clips 30 may have different sized hooked portions if significantly thicker tiles are to be used. Tiles may be in the range of 3 mms to 12 mms and hence there may be one retaining clip which has a hooked portion opening such that tiles of 3 to 7 mms may be received in it and another with an opening so that tiles between 8 and 12 mms can be received in it.

To replace a retaining clip it will be noted that advantageously a guide slot as shown by the arrow 56 is formed between the upper flange 52 of the Z shaped roof batten 50 and the underside of the weather strip 10 so that it is relatively straight forward to push a new retaining clip in and have the ears 38 engage into the aperture 40. Where the battens are timber there will still be a slot through which the retaining clip may be fed to enable the ears to engage into the apertures 40 in the sides of the weather strip.

The present invention has a number of advantages over the prior art. As noted previously the prior art describes the tabs for retaining the tiles are formed on and are part of the weather strip. The weather strip and tabs are constructed from mild steel, and thus the tabs to have sufficient strength have to be of reasonable width.

One particular advantage of the resilient retaining clip of the present invention is that it can be removed without removal of the entire weather strip by moving together the hooked portions 42 on each leg so that the ears 38 disengage with the apertures 40 in the sides of the weather strip so that the retaining clip can be completely removed which will allow the tile to be removed.

The wire clip is secured to the weather strip at a position remote from the corrosive atmosphere and thus away from condensation and to extend out to the end of the tile.

The wire shape can be easily changed to hold a variety of tile shapes without having to produce another weather strip, thus maintaining economies.

If only one tile is to be removed then one of the respective hooked portions 42 on adjacent weather strips can be moved apart so that the tile is freed.

The wire clip is not very visible whereas the tabs attached to the weather strips are relatively visible, even though they may painted or coated to match the tiles. Hence if tiles of different colour are employed, the weather strip must also be changed. However with the wire clip, no change of the weather strip is required. Additionally if tiles have to be changed the bending to release the tile and re-bending to secure the tile again can result in cracking of the paint or coating on the tab.

Additionally in climates having snow falls on the roof, as the snow slides off the roof, the tabs can be bent thus releasing of the tiles. With a wire clip the small area presented to the sliding snow and the strength of the stainless steel wire clip does not cause the wire clip to be bent.

To replace a retaining clip it will be noted that advantageously a guide slot as shown by the arrow 56 is formed between the upper flange 52 of the Z shaped roof batten 50 and the underside of the weather strip 10 so that it is relatively straight forward to push a new retaining clip in and have the ears 38 engage into the aperture 40. Where the battens are timber there will still be a slot through which the retaining clip may be fed to enable the ears to engage into the apertures 40 in the sides of the weather strip.

Because the retaining clip is preferably made from a stainless steel it will not corrode in the atmosphere and cause streaking on tiles. The wire also is of a relatively small diameter and hence it will be not effectively visible on the roof so a more even roof structure can be seen. Additionally the wire clip is not so prone to retain moisture and debris as do wider tabs.

Throughout this specification various indications have been given as to the scope of this invention but the invention is not limited to any one of these but may reside in two or more of these combined together. The examples are given for illustration only and not for limitation.

Throughout this specification and the claims that follow unless the context requires otherwise, the words 'comprise' and 'include' and variations such as 'comprising' and 'including' will be understood to imply the inclusion of a stated integer or group of integers but not the exclusion of any other integer or group of integers.

What is claimed is:

1. A weather strip and roof element adapted to support roof tile and adapted to extend between adjacent roof battens and to be supported thereby, said weather strip having a length such that in use a lower end portion of said weather strip adapted to projects beyond said adjacent roof battens, said roof tile adapted to being supported along marginal edges of said roof tile by an adjacent weather strip, retention means adapted to retaining said roof tile in position, said retention means comprising a stainless steel wire clip engaged in said weather strip to retain said weather strip in position, said wire clip being substantially U-shaped having a pair of legs having a hooked end to hook over a lower end of said roof tile, an ear extending laterally from each leg, said weather strip having side flanges, an aperture in said side flanges to receive the respective ear and lock the clip to said weather strip, wherein said weather strip has side tabs to be nailed or screwed to a lower batten and an upper tab projecting in a downward direction and substantially perpendicular to a planar plane of the top surface of said weather strip adapted to be nailed or screwed to an adjacent upper batten.

2. A weather strip and roof element adapted to support a roof tile and adapted to extend between adjacent roof battens and to be supported thereby, said weather strip having a length such that in use a lower end portion of said weather strip adapted to projects beyond said adjacent roof battens, said roof tile adapted to being supported along marginal edges of said roof tile by an adjacent weather strip, retention means adapted to retaining said roof tile in position, said retention means comprising a stainless steel wire clip engaged in said weather strip to retain said weather strip in position, said wire clip being substantially U-shaped having a pair of legs having a hooked end to hook over a lower end of said roof tile, an ear extending laterally from each leg, said weather strip having side flanges, an aperture in said side flanges to receive the respective ear and lock the clip to said weather strip, wherein said weather strip has a downwardly facing notch on said side flanges adapted to engage an upwardly facing flange on a lower batten, wherein said weather strip has at least two strips of longitudinally extending sealant to seal under the respective sides of adjacent tiles, wherein said weather strip has longitudinally extending grooves to assist in the shedding of water therefrom, wherein said weather strip has side tabs adapted to be nailed or screwed to a lower batten and an upper tab projecting in a downward direction and substantially perpendicular to a planar plane of the top surface of said weather strip adapted to be nailed or screwed to an adjacent upper batten.

* * * * *